US009055626B2

(12) United States Patent
Chen et al.

(10) Patent No.: US 9,055,626 B2
(45) Date of Patent: Jun. 9, 2015

(54) DIMMER CIRCUIT AND LIGHTING APPARATUS USING THE SAME

(71) Applicant: Lextar Electronics Corporation, Hsinchu (TW)

(72) Inventors: Chun-Kuang Chen, Taipei (TW); Po-Shen Chen, New Taipei (TW); Feng-Ling Lin, Pingtung (TW); Hui-Ying Chen, Changhua County (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 226 days.

(21) Appl. No.: 13/893,374

(22) Filed: May 14, 2013

(65) Prior Publication Data

US 2014/0111105 A1 Apr. 24, 2014

(30) Foreign Application Priority Data

Oct. 19, 2012 (TW) ..... 101138777 A

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 37/02*** | (2006.01) |
| ***H05B 33/08*** | (2006.01) |

(52) U.S. Cl.

CPC ..... *H05B 37/02* (2013.01); *H05B 33/08* (2013.01); *H05B 33/0815* (2013.01); *H05B 33/0848* (2013.01)

(58) Field of Classification Search

CPC ..... H05B 37/02; H05B 33/08

USPC ..... 315/200 R, 307, 287, 224, 119, 151, 315/205–208, 201, 310, 311, 121, 123, 125, 315/126, 127, 128; 327/108–112, 379–381, 327/387, 389; 326/82, 83

See application file for complete search history.

(56) References Cited

U.S. PATENT DOCUMENTS

| | | | | |
|---|---|---|---|---|
| 2011/0140620 | A1* | 6/2011 | Lin et al. | 315/224 |
| 2011/0291583 | A1* | 12/2011 | Shen | 315/287 |
| 2012/0056553 | A1* | 3/2012 | Koolen et al. | 315/291 |
| 2012/0235585 | A1* | 9/2012 | Lys et al. | 315/200 R |
| 2013/0169177 | A1* | 7/2013 | Liao et al. | 315/200 R |
| 2014/0203721 | A1* | 7/2014 | Qiao et al. | 315/201 |

FOREIGN PATENT DOCUMENTS

TW M366854 10/2009

OTHER PUBLICATIONS

English Abstract translation of TWM366854 (Published Oct. 11, 2009).

* cited by examiner

*Primary Examiner* — Lincoln Donovan
*Assistant Examiner* — Thomas Skibinski
(74) *Attorney, Agent, or Firm* — McClure, Qualey & Rodack, LLP

(57) ABSTRACT

A dimmer circuit and a lighting apparatus using the same are provided. The dimmer circuit comprises a dimmer, a rectifier, a sample-and-hold unit, an integral unit and a current holding circuit. The dimmer is coupled to an AC for modulating the AC into an alternating signal. The rectifier couples the dimmer and the AC for rectifying the alternating signal into a DC signal. The sample-and-hold unit is coupled to the rectifier for sampling the DC signal to obtain an average positive wave pulse. The integral unit is coupled to the sample-and-hold unit for integrating the average positive wave pulse to generate a DC voltage. The current holding circuit comprises a switch and a bleeder. The current holding circuit determines the on/off state of the switch according to a comparison between the DC voltage and a reference voltage, such that the DC signal passes through the bleeder or the switch.

19 Claims, 1 Drawing Sheet

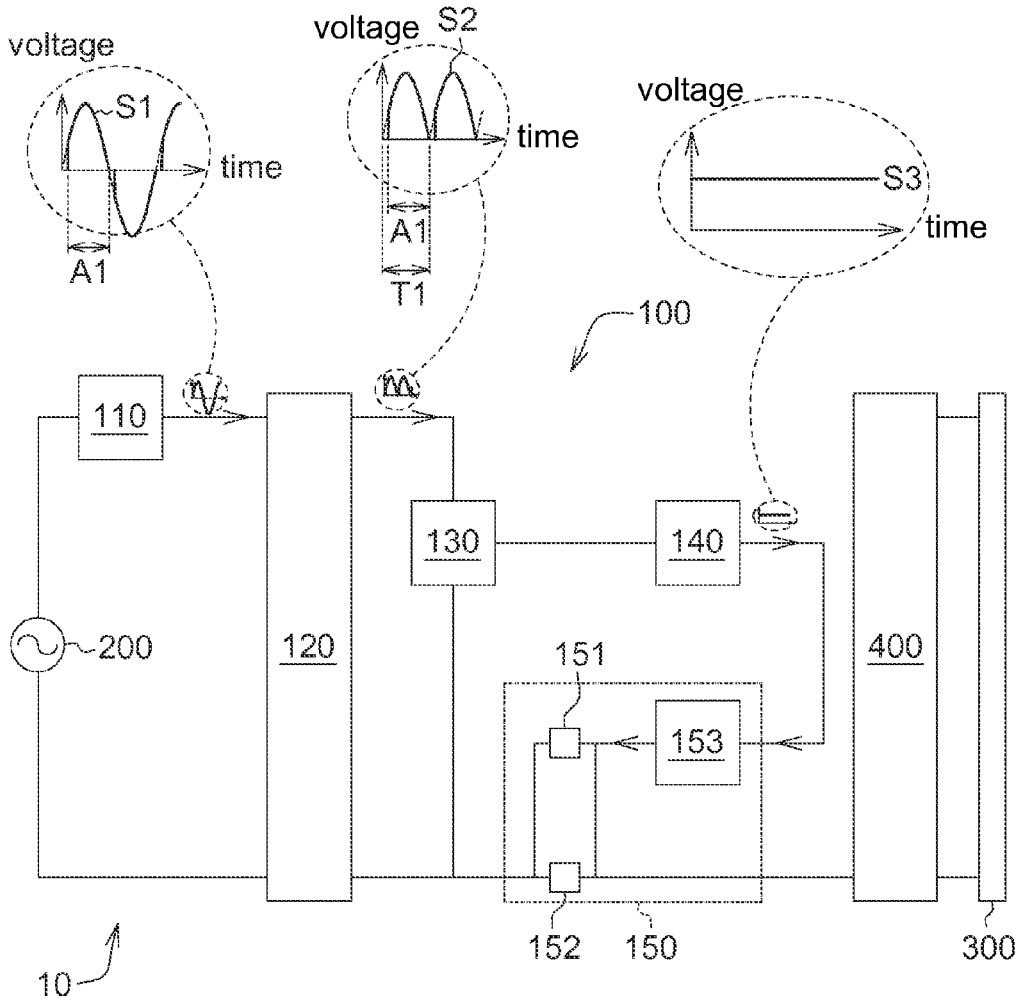
voltage
S1
time
A1
voltage
S2
time
A1
T1
voltage
S3
time
100
110
130
140
200
120
151
153
400
152
150
300
10

DIMMER CIRCUIT AND LIGHTING APPARATUS USING THE SAME

This application claims the benefit of Taiwan application Serial No. 101138777, filed Oct. 19, 2012, the subject matter of which is incorporated herein by reference.

BACKGROUND OF THE INVENTION

1. Field of the Invention

The invention relates in general to a dimmer circuit and a lighting apparatus using the same, and more particularly to a dimmer circuit used in light emitting diode (LED) and a lighting apparatus using the same.

2. Description of the Related Art

In recent years, LED has gradually replaced the incandescent lamps to save energy consumption. Although the I LED load is not a resistive load, the dimmer is still needed to adjust the bright/dark level of the LED.

According to a currently used method, a high-watt resistor is serially connected to the input end of the driving circuit of the LED. However, when the dimmer outputs a high conduction angle, the working current of LED increases, and the resistor ends up with more energy consumption.

SUMMARY OF THE INVENTION

The invention is directed to a dimmer circuit and a lighting apparatus using the same capable of improving energy loss at high conduction angle.

According to an embodiment of the present invention, a dimmer circuit is provided. The dimmer circuit comprises a dimmer, a rectifier, a sample-and-hold unit, an integral unit and a current holding circuit. The dimmer is coupled to an alternating current (AC) for modulating the AC into an AC light modulating signal. The AC light modulating signal contains multiple wave pulses each having an adjustable conduction angle. The rectifier couples the dimmer and the AC for converting the AC light modulating signal into a direct current (DC) light modulating signal having multiple positive wave pulses. The sample-and-hold unit is coupled to the rectifier for continuously sampling the positive wave pulses of the DC light modulating signal to obtain an average positive wave pulse. The integral unit is coupled to the sample-and-hold unit for integrating the average positive wave pulse to generate a DC voltage. One end of the current holding circuit is coupled to the sample-and-hold unit and the rectifier and the other end is coupled to the integral unit. The current holding circuit comprises a bleeder and a switch. The switch is coupled to the bleeder. The current holding circuit determines the on/off state of the switch according to a comparison between the DC voltage and a reference voltage, such that the DC light modulating signal passes through the bleeder or the switch.

According to another embodiment of the present invention, a lighting apparatus is provided. The lighting apparatus comprises a solid state lighting lamp and a dimmer circuit. The dimmer circuit is coupled to the solid state lighting lamp for adjusting the brightness of the solid state lighting lamp. The dimmer circuit comprises a dimmer, a rectifier, a sample-and-hold unit, an integral unit and a current holding circuit. The dimmer is coupled to an AC for modulating the AC into an AC light modulating signal. The AC light modulating signal contains multiple wave pulses each having an adjustable conduction angle. The rectifier couples the dimmer and the AC for converting the AC light modulating signal into a DC light modulating signal having multiple positive wave pulses. The sample-and-hold unit is coupled to the rectifier for continuously sampling the positive wave pulses of the DC light modulating signal to obtain an average positive wave pulse. The integral unit is coupled to the sample-and-hold unit for integrating the average positive wave pulse to generate a DC voltage. One end of the current holding circuit is coupled to the sample-and-hold unit and the rectifier, and the other end is coupled to the integral unit. The current holding circuit comprises a bleeder and a switch. The switch is coupled to the bleeder. The current holding circuit determines the on/off state of the switch according to a comparison between the DC voltage and a reference voltage, such that the DC light modulating signal passes through the bleeder or the switch.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

FIG. 1 shows a functional block diagram of a dimmer circuit according to an embodiment of the invention.

DETAILED DESCRIPTION OF THE INVENTION

FIG. 1 shows a functional block diagram of a dimmer circuit according to an embodiment of the invention. The dimmer circuit 100 comprises a dimmer 110, a rectifier 120, a sample-and-hold unit 130, an integral unit 140 and a current holding circuit 150.

The dimmer 110 is coupled to an alternating current (AC) 200 for modulating the AC 200 into an AC light modulating signal S1. The AC light modulating signal S1 contains multiple wave pulses each having an adjustable conduction angle A1.

The rectifier 120 is coupled to the dimmer 110 and the AC 200 for converting the AC light modulating signal S1 into a direct current (DC) light modulating signal S2 having multiple positive wave pulses. The DC light modulating signal S2 can be transmitted to the driving circuit 400, which further provides the DC light modulating signal S2 to the solid state lighting lamp 300. On the other hand, the DC light modulating signal S2 can also be transmitted to the sample-and-hold unit 130, such that the bleeder 152 or the switch 151 can be turned on. In the present example, the rectifier 120 is a full-wave rectifier, but the embodiment of the invention is not limited thereto.

The sample-and-hold unit 130 is coupled to the rectifier 120 for continuously sampling the positive wave pulses of the DC light modulating signal S2 to obtain an average positive wave pulse. The sample-and-hold unit 130 further obtains a period T1 and a conduction angle A1 of the DC light modulating signal S2.

The integral unit 140 is coupled to the sample-and-hold unit 130 for integrating the average positive wave pulse according to the period T1 and the conduction angle A1 and obtaining an average value of the integral, that is, the DC voltage S3.

One end of the current holding circuit 150 is coupled to the sample-and-hold unit 130 and the rectifier 120, and the other end is coupled to the integral unit 140. The current holding circuit 150 comprises a bleeder 152 and a switch 151. The bleeder 152 is a passive element or an active element, wherein the passive element is such as a resistor, and the active element is such as a metal oxide semiconductor (MOS) element. The switch 151 is an active element such as a metal oxide semiconductor element. The switch 151 is coupled to the bleeder 152. In the present example, the bleeder 152 and the switch 151 are connected in parallel. In another example, the bleeder 152 and the switch 151 can be combined as one single element, such as a metal oxide semiconductor element.

The current holding circuit 150 determines whether the switch 151 is turned on or turned off according to a comparison between the DC voltage S3 and a reference voltage, such that the DC light modulating signal S2 passes through the bleeder 152 or the switch 151. The value range of the reference voltage is between 2.25~2.65V. The voltage range is a range of corresponding voltage values simulated or calculated according to a range of high conduction angle. In another embodiment, the reference voltage may have other voltage range.

In the present example, the current holding circuit 150 further comprises a comparison unit 153 coupled between the integral unit 140 and the switch 151 for comparing the DC voltage S3 with the reference voltage. When the DC voltage S3 is smaller than the reference voltage, the comparison unit 153 controls the switch 151 to be turned off, such that the DC light modulating signal S2 passes through the bleeder 152. In terms of one of the controlling methods, the comparison unit 153 may output a low level signal to the switch 151, such that the switch 151 is turned off and the DC light modulating signal S2 can only pass through the bleeder 152. Conversely, when the DC voltage S3 is larger than the reference voltage, the comparison unit 153 controls the switch 151 to be turned on, such that the DC light modulating signal S2 passes through the switch 151. In terms of one of the controlling methods, the comparison unit 153 may output a high level signal to the switch 151, such that the switch 151 is turned on and the DC light modulating signal S2 can pass through the switch 151 with lower impedance.

To summarize, when the dimmer 110 outputs a low conduction angle, the DC light modulating signal S2 passes through the bleeder 152 to increase the holding current and improve the flickering phenomenon which occurs when the conduction angle is low. When the dimmer 110 outputs a high conduction angle, the DC light modulating signal S2 passes through the switch 151 to improve or avoid energy loss which occurs when the DC light modulating signal S2 passes through the bleeder 152.

As indicated in FIG. 1, the dimmer circuit 100 can be used in the field of illumination. For example, a lighting apparatus 10 comprises a dimmer circuit 100, a solid state lighting lamp 300 and a driving circuit 400. The dimmer circuit 100 is coupled to the solid state lighting lamp 300 for adjusting the brightness of the solid state lighting lamp 300. The solid state lighting lamp 300 is such as various types of LED. The driving circuit 400 is coupled between the dimmer circuit 100 and the solid state lighting lamp 300 for receiving the DC light modulating signal S2 from the rectifier 120 to drive the solid state lighting lamp 300.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dimmer circuit, comprising:

a dimmer coupled to an alternating current (AC) for modulating the AC into an AC light modulating signal, wherein the AC light modulating signal contains a plurality of wave pulses each having a conduction angle;

a rectifier coupling the dimmer and the AC for converting the AC light modulating signal into a direct current (DC) light modulating signal having a plurality of positive wave pulses;

a sample-and-hold unit coupled to the rectifier for continuously sampling the positive wave pulses of the DC light modulating signal to obtain an average positive wave pulse;

an integral unit coupled to the sample-and-hold unit for integrating the average positive wave pulse to generate a DC voltage; and a current holding circuit, wherein one end of the current holding circuit is coupled to the sample-and-hold unit and the rectifier, the other end of the current holding circuit is coupled to the integral unit, and the current holding circuit comprises:

a bleeder; and a switch coupled to the bleeder;

wherein, the current holding circuit determines on state or off state of the switch according to a comparison between the DC voltage and a reference voltage, such that the DC light modulating signal passes through the bleeder or the switch.

2. The dimmer circuit according to claim 1, wherein the current holding circuit further comprises:

a comparison unit coupled between the integral unit and the switch for comparing the DC voltage with the reference voltage, wherein when the DC voltage is smaller than the reference voltage, the comparison unit controls the switch to be turned off, such that the DC light modulating signal passes through the bleeder, and when the DC voltage is larger than the reference voltage, the comparison unit controls the switch to be turned on, such that the DC light modulating signal passes through the switch.

3. The dimmer circuit according to claim 2, wherein the bleeder is a passive element or an active element.

4. The dimmer circuit according to claim 3, wherein the passive element is a resistor, and the active element is a metal oxide semiconductor (MOS) element.

5. The dimmer circuit according to claim 2, wherein the switch is an active element.

6. The dimmer circuit according to claim 5, wherein the active element is a metal oxide semiconductor element.

7. The dimmer circuit according to claim 1, wherein the bleeder and the switch are integrated into a metal oxide semiconductor element.

8. The dimmer circuit according to claim 1, wherein the rectifier is a full-wave rectifier.

9. The dimmer circuit according to claim 1, wherein the bleeder and the switch are connected in parallel.

10. A lighting apparatus, comprising:

a solid state lighting lamp; and a dimmer circuit coupled to the solid state lighting lamp for adjusting a brightness of the solid state lighting lamp, and comprising:

a dimmer coupled to an AC for modulating the AC into an AC light modulating signal, wherein the AC light modulating signal contains a plurality of wave pulses each having a conduction angle;

a rectifier coupling the dimmer and the AC for converting the AC light modulating signal into a DC light modulating signal having a plurality of positive wave pulses;

a sample-and-hold unit coupled to the rectifier for continuously sampling the positive wave pulses of the DC light modulating signal to obtain an average positive wave pulse;

an integral unit coupled to the sample-and-hold unit for integrating the average positive wave pulse to generate a DC voltage; and a current holding circuit, wherein one end of the current holding circuit is coupled to the sample-and-hold unit and the rectifier, the other end of the current holding circuit is coupled to the integral unit, and the current holding circuit comprises:

a bleeder; and a switch coupled to the bleeder;

wherein, the current holding circuit determines on state or off state of the switch according to a comparison between the DC voltage and a reference voltage, such that the DC light modulating signal passes through the bleeder or the switch.

11. The lighting apparatus according to claim 10, further comprising:

a driving circuit coupled between the dimmer circuit and the solid state lighting lamp for receiving the DC light modulating signal from the rectifier to drive the solid state lighting lamp.

12. The lighting apparatus according to claim 10, wherein the current holding circuit further comprises:

a comparison unit coupled between the integral unit and the switch for comparing the DC voltage with the reference voltage, wherein when the DC voltage is smaller than the reference voltage, the comparison unit controls the switch to be turned off, such that the DC light modulating signal passes through the bleeder, and when the DC voltage is larger than the reference voltage, the comparison unit controls the switch to be turned on, such that the DC light modulating signal passes through the switch.

13. The lighting apparatus according to claim 12, wherein the bleeder is a passive element or an active element.

14. The lighting apparatus according to claim 13, wherein the passive element is a resistor, and the active element is a MOS element.

15. The lighting apparatus according to claim 12, wherein the switch is an active element.

16. The lighting apparatus according to claim 15, wherein the active element is a metal oxide semiconductor element.

17. The lighting apparatus according to claim 11, wherein the bleeder and the switch are integrated into a metal oxide semiconductor element.

18. The lighting apparatus according to claim 11, wherein the rectifier is a full-wave rectifier.

19. The lighting apparatus according to claim 11, wherein the bleeder and the switch are connected in parallel.

* * * * *